US007878024B2

(12) United States Patent
Baik

(10) Patent No.: US 7,878,024 B2
(45) Date of Patent: Feb. 1, 2011

(54) EARRING

(75) Inventor: Kyung-Hak Baik, Euiwang (KR)

(73) Assignee: Core Jewelry, Inc., New York, NY (US)

( * ) Notice: Subject to any disclaimer, the term of this patent is extended or adjusted under 35 U.S.C. 154(b) by 0 days.

(21) Appl. No.: 12/339,586

(22) Filed: Dec. 19, 2008

(65) Prior Publication Data

US 2010/0122554 A1 May 20, 2010

(30) Foreign Application Priority Data

Nov. 15, 2008 (KR) ..... 10-2008-0113700

(51) Int. Cl.
*A44C 7/00* (2006.01)

(52) U.S. Cl. ..... 63/12; 63/3.1; 24/574.1; 24/629

(58) Field of Classification Search ..... 63/3.1, 63/12, 14.5; 24/574.1, 587.11, 629, 633, 24/640, 643, 647
See application file for complete search history.

(56) References Cited

U.S. PATENT DOCUMENTS

| | | | | |
|---|---|---|---|---|
| 3,413,692 | A * | 12/1968 | Pressley | 24/602 |
| 3,765,064 | A | 10/1973 | Hoober et al. | |
| 4,694,664 | A | 9/1987 | Elsener | |
| 4,763,490 | A | 8/1988 | Bruner | |
| 4,924,562 | A * | 5/1990 | Pogharian | 24/647 |
| 5,272,795 | A | 12/1993 | Rothstein | |
| 5,628,095 | A | 5/1997 | Appel et al. | |
| 6,145,171 | A | 11/2000 | Hoshino | |
| 6,317,941 | B1 | 11/2001 | Hamm, Jr. | |
| 6,481,069 | B1 * | 11/2002 | Cheng | 24/647 |
| 6,484,376 | B1 * | 11/2002 | Khatchadourian et al. | 24/658 |
| 6,508,080 | B1 * | 1/2003 | Ninomiya | 63/3.1 |
| 6,843,072 | B1 * | 1/2005 | Lau | 63/12 |
| 7,082,651 | B2 * | 8/2006 | Ninomiya | 24/658 |
| 7,322,076 | B2 | 1/2008 | Ninomiya | |
| 7,347,065 | B1 | 3/2008 | DeGolyer | |

FOREIGN PATENT DOCUMENTS

| | | |
|---|---|---|
| CA | 222978 | 9/1978 |
| DE | 200610032400 | 1/2008 |
| FR | 19810007515 | 1/1984 |
| JP | 20020248388 | 3/2004 |

* cited by examiner

*Primary Examiner*—David Reese
(74) *Attorney, Agent, or Firm*—Sofer & Haroun, LLP

(57) ABSTRACT

An earring includes an earring body, a locking bar provided at one end of the earring body and formed with a locking groove, and a locker provided at the other end of the earring body to be selectively locked with the locking bar. The locker is formed with an insert groove, the insert groove is provided at an inside thereof with a locking protrusion, and a locking release button is positioned adjacent to the locking protrusion while protruding out of the locker. The spring includes a compression spring and the locking protrusion is adapted to lock with the locking groove of the locking bar while performing a straight movement in a state in which the locking protrusion is elastically supported to the spring. The locking/unlocking operations of the coupling parts are easily performed and an aesthetic appearance of the earring is improved.

10 Claims, 3 Drawing Sheets

EARRING

BACKGROUND OF THE INVENTION

1. Field of the Invention

The present invention relates to an earring. More particularly, the present invention relates to an earring capable of easily performing the locking/unlocking operation of coupling parts and improving an aesthetic appearance of the earring.

2. Description of the Related Art

In general, accessories are classified into necklaces, bracelets, anklets, and earrings, which are wound on necks, arms, legs of a human body or worn on ears in order to exhibit individual preferences or characters in combination with dresses. The accessory is diversely designed according to the user's taste and preference and is on sale in the market.

This accessory is manufactured by connecting various types of jewels to each other using one wire.

This accessory is provided at a final coupling point thereof with coupling parts, and the user can wear the accessory on the user's body by coupling the coupling parts to each other. Especially, since the coupling parts of an earring are inserted into earlobes, which are the weakest parts of the body, the coupling parts should be manufactured precisely and the coupling/decoupling operation thereof must be facilitated.

However, the coupling/decoupling operation of the conventional earring is very difficult and the coupling parts are excessively exposed to the exterior, so that an aesthetic appearance of the earring may be deteriorated.

SUMMARY OF THE INVENTION

Accordingly, the present invention has been made to solve the above-mentioned problems occurring in the prior art, and an object of the present invention is to provide an earring capable of easily performing the locking/unlocking operation of coupling parts and improving an aesthetic appearance of the earring.

In order to accomplish the above object, according to one aspect of the present invention, there is provided an earring including an earring body, a locking bar provided at one end of the earring body and formed with a locking groove, and a locker provided at the other end of the earring body to be selectively locked with the locking bar, wherein the locker is formed with an insert groove into which the locking bar is inserted, the insert groove is provided at an inside thereof with a locking protrusion, which is elastically locked with the locking groove of the locking bar by a spring, a locking release button for releasing the locking of the locking protrusion is positioned adjacent to the locking protrusion while protruding out of the locker, the spring includes a compression spring and the locking protrusion is adapted to lock with the locking groove of the locking bar while performing a straight movement in a state in which the locking protrusion is elastically supported to the spring.

According to another aspect of the present invention, there is provided an earring including an earring body, a locking bar provided at one end of the earring body and formed with a locking groove, and a locker provided at the other end of the earring body to be selectively locked with the locking bar, wherein the locker is formed with an insert groove into which the locking bar is inserted, the insert groove is provided at an inside thereof with a locking protrusion, which is elastically locked with the locking groove of the locking bar by a spring, a locking release button for releasing the locking of the locking protrusion is positioned adjacent to the locking protrusion while protruding out of the locker, the spring includes a torsion spring and the locking protrusion is rotated in the insert groove about a hinge and adapted to lock with the locking groove of the locking bar while performing a rotational motion in a state in which the locking protrusion is elastically supported to the spring.

As mentioned above, the earring according to the present invention can easily perform the locking/unlocking operation of coupling parts and improve an aesthetic appearance of the earring.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENT

Hereinafter, preferred embodiments of the present invention will be described in detail with reference to the accompanying drawings.

Figure 1:
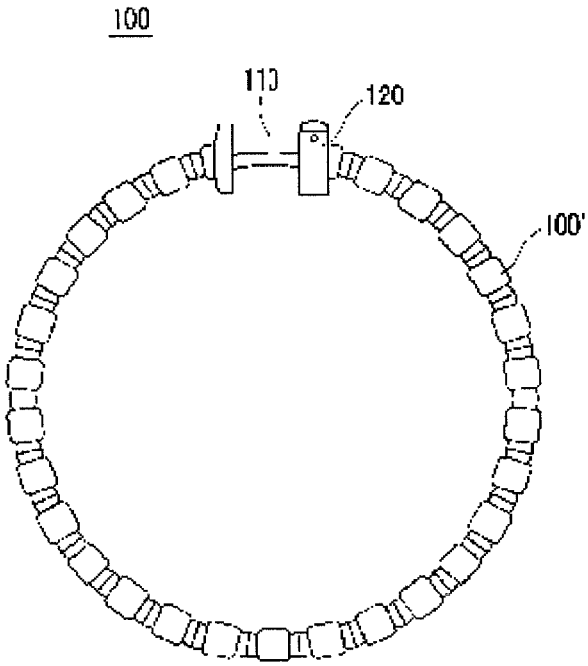
FIG. 1 is a front view showing an earring according to an exemplary embodiment of the present invention.
Figure 2:
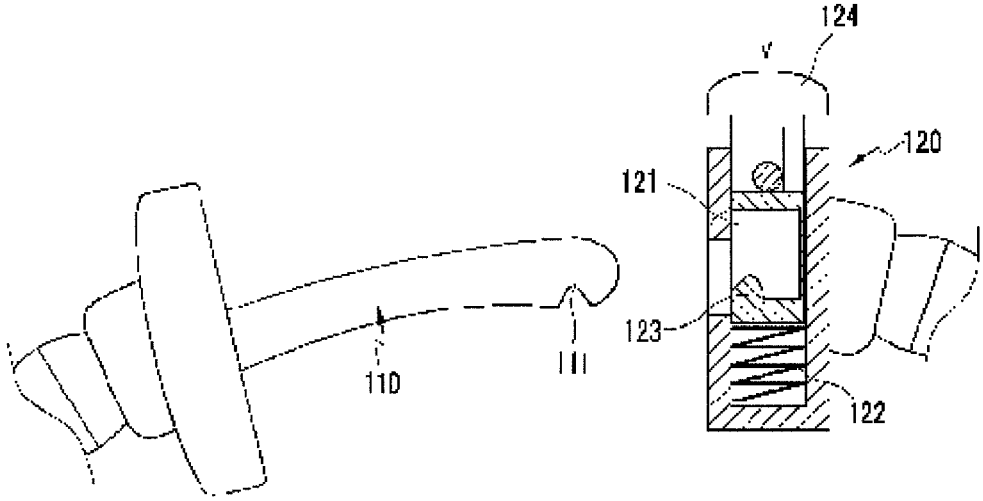
FIG. 2 is a sectional view showing an unlocking state of an earring according to an exemplary embodiment of the present invention.
Figure 3:
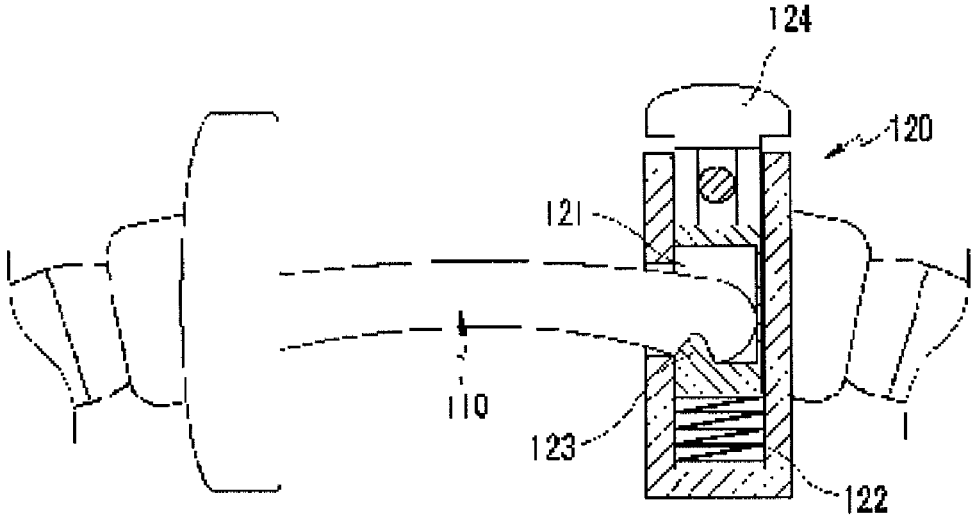
FIG. 3 is a sectional view showing a locking state of an earring according to an exemplary embodiment of the present invention.
Figure 4:
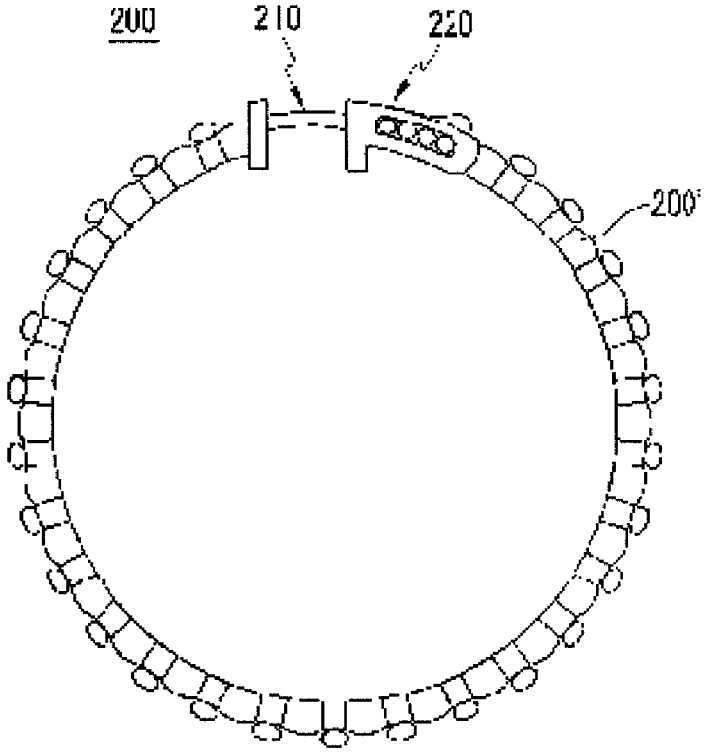
FIG. 4 is a front view showing an earring according to another exemplary embodiment of the present invention.

FIG. 1 is a front view showing an earring according to an exemplary embodiment of the present invention, FIG. 2 is a sectional view showing an unlocking state of the earring according to an exemplary embodiment of the present invention, and FIG. 3 is a sectional view showing a locking state of the earring according to an exemplary embodiment of the present invention.

As shown in FIGS. 1 to 3, the earring 100 according to an exemplary embodiment of the present includes coupling parts 110 and 120, which are provided at both ends of an earring body 100', respectively.

In detail, the earring body 100' is provided at one end thereof with a locking bar 110 having a locking groove 111. In addition, the earring body 100' is also provided at the other end thereof with a locker 120, which is selectively locked with the locking bar 110.

The locking bar 110 and the locker 120 are formed at both distal ends of the earring body 100' while facing each other, respectively.

The locker 120 is formed with an insert groove 121, into which the locking bar 110 can be inserted. The insert groove 121 is provided at the inside thereof with a locking protrusion 123, which is elastically locked with the locking groove 111 of the locking bar 110 by a spring 122.

A locking release button 124 for releasing the locking of the locking protrusion 123 is positioned adjacent to the locking protrusion 123 while protruding out of the locker 120.

The spring 122 includes a compression spring and the locking protrusion 123 is adapted to lock with the locking groove 111 of the locking bar 110 while performing a straight movement a state in which the locking protrusion 123 is elastically supported to the spring 122.

Hereinafter, the operation of the earring 100 having the construction as described above according to an embodiment of the present invention will be described.

When the locking bar 110 is inserted into the insert groove 121 of the locker 120 and then moved forward, the locking bar 110 makes contact with the locking protrusion 123. As the locking bar 110 is further moved forward, the locking bar 110 moves down while overcoming elastic force of the compression spring 122. At this time, the locking protrusion 123 will be locked with the locking groove 111 of the locking bar 110 while being elastically inserted into the locking groove 111.

In order to release the locking of the coupling parts 110 and 120, the locking release button 124 is pressed first, so that the locking protrusion 123 descends downward again while compressing the compression spring 122.

At this time, the locking protrusion 123 is separated from the locking groove 111 of the locking bar 110, so that the coupling parts 110 and 120 can be unlocked.

Figure 5:
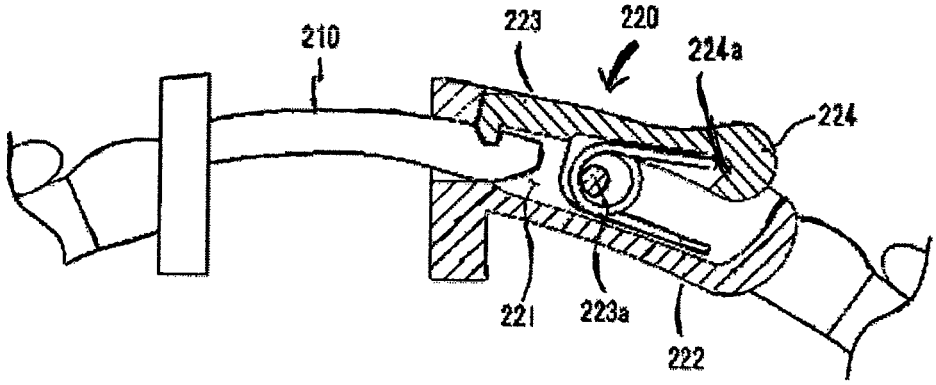
FIG. 5 is a sectional view showing a locking state of an earring according to another exemplary embodiment of the present invention.
Figure 6:
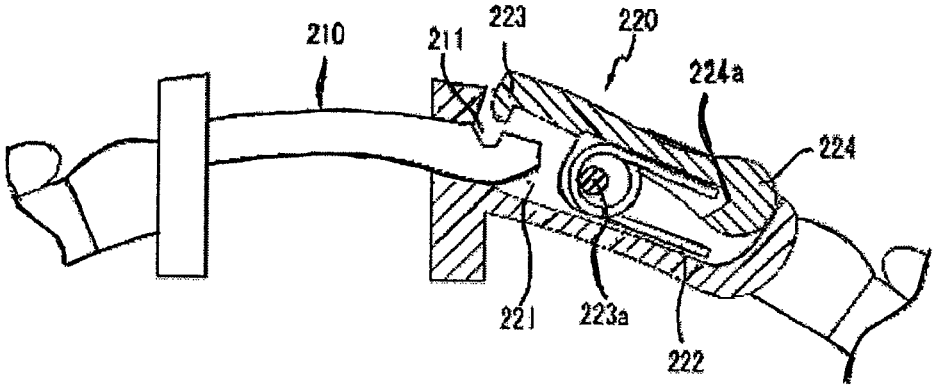
FIG. 6 is a sectional view showing an operational state of a locking release button shown in FIG. 5.
Figure 7:
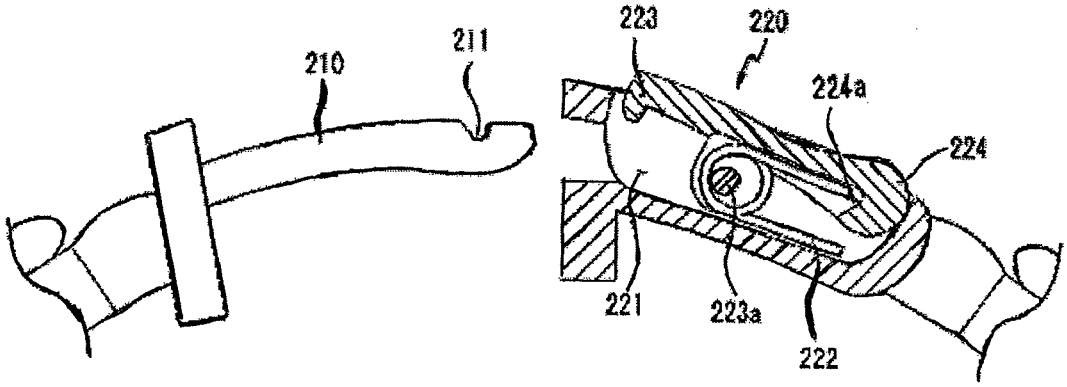
FIG. 7 is a sectional view showing an unlocking state of an erring.

Meanwhile, FIG. 5 is a sectional view showing a locking state of an earring according to another exemplary embodiment of the present invention, FIG. 6 is a sectional view showing an operational state of the locking release button shown in FIG. 5, and FIG. 7 is a sectional view showing the unlocking state of the earring.

As shown in FIGS. 5 to 7, the earring 200 according to another exemplary embodiment of the present includes coupling parts 210 and 220, which are provided at both ends of an earring body 200', respectively.

In detail, the earring body 200' is provided at one end thereof with a locking bar 210 having a locking groove 211. In addition, the earring body 200' is also provided at the other end thereof with a locker 220, which is selectively locked with the locking bar 210.

The locker 220 is formed with an insert groove 221, into which the locking bar 210 can be inserted. The insert groove 221 is provided at the inside thereof with a locking protrusion 223, which is elastically locked with the locking groove 211 of the locking bar 210 by a spring 222.

A locking release button 224 for releasing the locking of the locking protrusion 223 is positioned adjacent to the locking protrusion 223 while protruding out of the locker 220. A fixing groove **224*a* is formed in an inner surface of the locking release button 224**.

The spring 222 includes a torsion spring and the locking protrusion 223 is rotated in the insert groove 221 about a hinge **223*a* and adapted to lock with the locking groove 211 of the locking bar 210, while performing a rotational motion in a state in which the locking protrusion 223 is elastically supported to the spring 222. One end of the spring 222 is inserted into the fixing groove 224*a*** to be supported.

Hereinafter, the operation of the earring 200 having the construction as described above according to another embodiment of the present invention will be described.

When the locking bar 210 is inserted into the insert groove 221 of the locker 220 and then moved forward, the locking bar 210 makes contact with the locking protrusion 223.

As the locking bar 210 is further moved forward, the locking bar 210 moves up while rotating about the hinge **223*a* against elastic spring force of the torsion spring 222**.

At this time, the locking protrusion 223 is locked with the locking groove 211 of the locking bar 210 while being elastically inserted into the locking groove 211 (see, FIG. 5).

In order to release the locking of the coupling parts 210 and 220, the locking release button 224 is pressed first, so that the locking protrusion 223 moves up while rotating about the hinge **223*a* (see, FIG. 6) against the elastic force of the torsion spring 222**.

At this time, the locking protrusion 223 is separated from the locking groove 211 of the locking bar 210, so that the coupling parts 210 and 220 can be unlocked (see, FIG. 7).

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

For example, according to the present invention, the locking bar and the structure of the locker, which is locked with the locking bar, are described as an example for an earring for the purpose of convenience, however, it can be understood that the locking structure can be also applied to a necklace, a bracelet, etc., in addition to the earring.

What is claimed is:

1. A jewelry item, comprising:

a body member having a first end and a second end;

a locking bar located at said first end of said body member, said locking bar having a locking groove;

a locker located at said second end of said body member, said locker having an insert groove, through which said locking bar may be inserted, said locker having an internal hinge post;

a locking release button within said locker and rotatable around said internal hinge post, said locking release button having a first engagement end for engagement of the locking groove of said locking bar and a second pressing end disposed on its opposite end, away from the locking groove, protruding out of said locker;

a torsional spring having first and second ends is disposed around the internal hinge post and at least a portion of which extends between said locking release button and opposing internal surface of said locker, said spring having an elastic spring force, said locking release button is provided with a longitudinal recess formed on an inner surface of said second pressing end as a sub-portion of said locking release button, aligned with the direction of said first end of said torsional spring such that said longitudinal recess formed on an inner surface of said second pressing end as a sub-portion of said locking release button encloses the entire portion of said first end of said torsional spring with said second end of said spring resting against the lower wall of locker;

so that when the first engagement end of said locking release button is received within the locking groove of said locking bar the body member is in a first closed position, and when the second pressing end is depressed, the first engagement end of said locking release button is rotated against the elastic spring force of said torsional spring whereby the first engagement end of said locking release button is separated from said locking groove, and said locking bar is decoupled from said locker placing said body member into a second open position.

2. The jewelry item of claim 1 wherein the internal hinge post is located between an upper side wall and the lower wall of said locker.

3. The jewelry item of claim 2 wherein said locking release button pivots about the hinge post through an opening in said upper wall of said locker.

4. The jewelry item of claim 1 wherein said jewelry item is selected from the group consisting of necklaces, earrings or bracelets.

5. The jewelry item of claim 1 wherein the locking groove is located on an upper surface of said locking bar.

6. The jewelry item of claim 1 wherein the engagement end of said locking release button is on a lower surface of said locking release button.

7. The jewelry item of claim 1 wherein said locking release button is a lever.

8. The jewelry item of claim 1, wherein said recess in said locking release button, for enclosing the entire portion of said first end of said torsional spring within, terminates prior to the end of said locking release button.

9. The jewelry item of claim 8, wherein said wherein said recess in said locking release button that terminates prior to the end of said locking release button, terminates in a rounded expanded area of said locking release button.

10. A jewelry item, comprising:

a body member having a first end and a second end;

a locking bar located at said first end of said body member, said locking bar having a locking groove;

a locker located at said second end of said body member, said locker having an insert groove, through which said locking bar may be inserted, said locker having an internal hinge post;

a locking release button within said locker and rotatable around said internal hinge post, said locking release button having a first engagement end for engagement of the locking groove of said locking bar and a second pressing end disposed on its opposite end, away from the locking groove, protruding out of said locker, wherein said pressing end of said locking release button, disposed on the opposite end from said first engagement end, is disposed at a distance away from said hinge post along the length of said locker away from said insert groove, is greater than the distance between said engagement end and said hinge post;

a torsional spring having first and second ends is disposed around the internal hinge post and at least a portion of which extends between said locking release button and opposing internal surface of said locker, said spring having an elastic spring force said locking release button is provided with a longitudinal recess formed on an inner surface of said second pressing end as a sub-portion of said locking release button, aligned with the direction of said first end of said torsional spring such that said longitudinal recess formed on an inner surface of said second pressing end as a sub-portion of said locking release button encloses the entire portion of said first end of said torsional spring with second end of said spring resting against the lower wall of locker;

so that when the first engagement end of said locking release button is received within the locking groove of said locking bar the body member is in a first closed position, and when the second pressing end is depressed, the first engagement end of said locking release button is rotated against the elastic spring force of said torsional spring whereby the first engagement end of said locking release button is separated from said locking groove, and said locking bar is decoupled from said locker placing said body member into a second open position.

* * * * *